US011250982B2

(12) United States Patent
Lai et al.

(10) Patent No.: US 11,250,982 B2
(45) Date of Patent: Feb. 15, 2022

(54) INGRESS-PROTECTIVE MECHANISM OF WIRE-WOUND MAGNETIC COMPONENT

(71) Applicant: CYNTEC CO., LTD., Hsinchu (TW)

(72) Inventors: Yi-Ting Lai, Hsinchu (TW); Chu-Keng Lin, Hsinchu (TW); Hsieh-Shen Hsieh, Hsinchu (TW)

(73) Assignee: CYNTEC CO., LTD, Hsinchu (TW)

( * ) Notice: Subject to any disclaimer, the term of this patent is extended or adjusted under 35 U.S.C. 154(b) by 533 days.

(21) Appl. No.: 16/024,497

(22) Filed: Jun. 29, 2018

(65) Prior Publication Data

US 2020/0005982 A1 Jan. 2, 2020

(51) Int. Cl.

| | |
|---|---|
| ***H01F 27/32*** | (2006.01) |
| ***H01F 27/02*** | (2006.01) |
| ***H01F 27/24*** | (2006.01) |
| ***H01F 27/28*** | (2006.01) |

(52) U.S. Cl.

CPC ..... *H01F 27/022* (2013.01); *H01F 27/24* (2013.01); *H01F 27/28* (2013.01); *H01F 27/325* (2013.01)

(58) Field of Classification Search

CPC ..... H01F 27/02; H01F 27/022; H01F 27/24; H01F 27/266; H01F 27/303; H01F 27/306; H01F 27/28; H01F 27/2823; H01F 27/32; H01F 27/323–325; H01F 27/327; H01F 5/02; H01F 2005/022

USPC ..... 336/196, 198, 199, 208

See application file for complete search history.

(56) References Cited

U.S. PATENT DOCUMENTS

| | | | | |
|---|---|---|---|---|
| 6,144,278 | A * | 11/2000 | Nishida | B41J 29/393 336/198 |
| 6,336,818 | B1 * | 1/2002 | Bayer | B60T 8/3675 336/192 |
| 6,344,787 | B1 * | 2/2002 | McGrane | H01F 27/02 336/192 |
| 10,210,992 | B2 | 2/2019 | Chuang | |
| 2006/0132272 | A1 * | 6/2006 | Kitahara | H01F 27/323 336/192 |
| 2009/0108976 | A1 * | 4/2009 | Nerone | H01F 27/326 336/192 |

(Continued)

FOREIGN PATENT DOCUMENTS

| | | | | |
|---|---|---|---|---|
| DE | 3335612 | A1 * | 4/1985 | H01F 27/324 |
| GB | 1246458 | A * | 9/1971 | H01F 19/08 |

(Continued)

*Primary Examiner* — Tszfung J Chan

(74) *Attorney, Agent, or Firm* — Kirton McConkie; Evan R. Witt

(57) ABSTRACT

A wire-wound magnetic component includes a magnetic core, a coil set, a bobbin, an insulating wrapper, a caulking member and an ingress-protective finishing film. The magnetic core has at least one leg. The coil set is aligned and interacts with the magnetic core for electromagnetic induction, wherein the coil set includes at least one coil. The bobbin includes: a main body having a hollow portion for accommodating the leg of the magnetic core, and winding therearound a conductive wire to form the coil set, wherein the conductive wire has an unwound free end extending from the coil set; a cover plate disposed at an end of the main body and configured as a flange so as to define a winding space for accommodating the coil set; and an ingress-protective structure disposed in the winding space and separating the coil set from the cover plate.

19 Claims, 17 Drawing Sheets

(56) References Cited

U.S. PATENT DOCUMENTS

| | | | | |
|---|---|---|---|---|
| 2010/0231200 | A1* | 9/2010 | Kurosawa | G01R 15/181 324/126 |
| 2012/0023870 | A1* | 2/2012 | Piascik | H01B 3/12 53/432 |
| 2015/0302979 | A1* | 10/2015 | Yang | H01F 27/025 336/59 |

FOREIGN PATENT DOCUMENTS

| | | | | |
|---|---|---|---|---|
| JP | 56064410 | A * | 6/1981 | H01F 27/327 |
| TW | I578340 | A | 4/2017 | |

* cited by examiner

INGRESS-PROTECTIVE MECHANISM OF WIRE-WOUND MAGNETIC COMPONENT

FIELD OF THE INVENTION

The present invention relates to an electric component, and more particularly to a wire-wound magnetic component having an ingress-protective mechanism.

BACKGROUND OF THE INVENTION

A wire-wound magnetic component, for example an inductor, reactor, choke, transformer or common mode choke, is a passive electronic component that stores energy in the form of a magnetic field when electric current flows therethrough and follows Faraday's law of induction. A wire-wound magnetic component typically consists of an electric conductor (wire) that is wound into a coil around a core. Furthermore, a wire-wound magnetic component, like other electronic devices, generally includes a protective structure to comply with at least the following requirements. Firstly, the protective structure isolates and protects a human body from the electronic parts, as well as isolates and protects the electronic parts from an invading article. Furthermore, the protective structure needs to be ingress-protective to avoid any possible damage resulting from liquid invasion and assure of stable and safe operations of the electronic device.

A conventional protective structure for a wire-wound magnetic component includes a metallic or plastic casing 11 enclosing the electronic parts of the wire-wound magnetic component 12 with a potting compound 13 filling therein, as illustrated in FIG. 1. It is understood that the additional metallic or plastic casing results in extra cost, not only on material but also on complicated manufacturing steps. Moreover, the entire wire-wound magnetic component would become too large to meet the commercial requirement.

SUMMARY OF THE INVENTION

Therefore, an object of the present invention is to provide a wire-wound magnetic component, which includes a compact protective structure with improved protecting performance.

In accordance with another aspect of the present invention, a wire-wound magnetic component includes a magnetic core, a coil set, a bobbin, an insulating wrapper, a caulking member and an ingress-protective finishing film. The magnetic core has at least one leg. The coil set is aligned and interacts with the magnetic core for electromagnetic induction, wherein the coil set includes at least one coil. The bobbin includes: a main body having a hollow portion for accommodating the leg of the magnetic core, and winding therearound a conductive wire to form the coil set, wherein the conductive wire has an unwound free end extending from the coil set; a cover plate disposed at an end of the main body and configured as a flange of the main body so as to define a winding space between the cover plate and the main body for accommodating the coil set; and an ingress-protective structure disposed in the winding space and separating the coil set from the cover plate. The insulating wrapper surrounds the ingress-protective structure and the coil set for sealing the entire coil set and the ingress-protective structure together with the cover plate. The caulking member is made of an ingress-protective material and applied to voids around the unwound free end at an exit from the coil set for ingress protection while further confining a bending range of the unwound free end. The ingress-protective finishing film conformally coated on surfaces of the bobbin and the insulating wrapper to provide surface protection of the wire-wound magnetic component.

In accordance with another aspect of the present invention, a wire-wound magnetic component includes a magnetic core, a coil set, a bobbin, an insulating wrapper, a caulking member and an ingress-protective finishing film. The magnetic core has at least one leg. The coil set is aligned and interacts with the magnetic core for electromagnetic induction, wherein the coil set includes at least one coil. The bobbin includes: a main body having a hollow portion for accommodating the leg of the magnetic core, and winding therearound a conductive wire to form the coil set, wherein the conductive wire has an unwound free end extending from the coil set; a cover plate disposed at an end of the main body and configured as a flange of the main body so as to define a winding space between the cover plate and the main body for accommodating the coil, wherein the cover plate has a wire passage for the unwound free end of the conductive wire to penetrate through and extend beyond the bobbin in a limited bending manner; and an ingress-protective structure disposed in the winding space and separating the coil set from the cover plate. The insulating wrapper surrounds the ingress-protective structure and the coil set for sealing the entire coil set and the ingress-protective structure together with the cover plate. The caulking member is made of an ingress-protective material and applied to voids around the unwound free end at an exit from the coil set for ingress protection while further confining a bending range of the unwound free end. The ingress-protective finishing film conformally coated on surfaces of the bobbin and the insulating wrapper to provide surface protection of the wire-wound magnetic component.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

Figure 1:
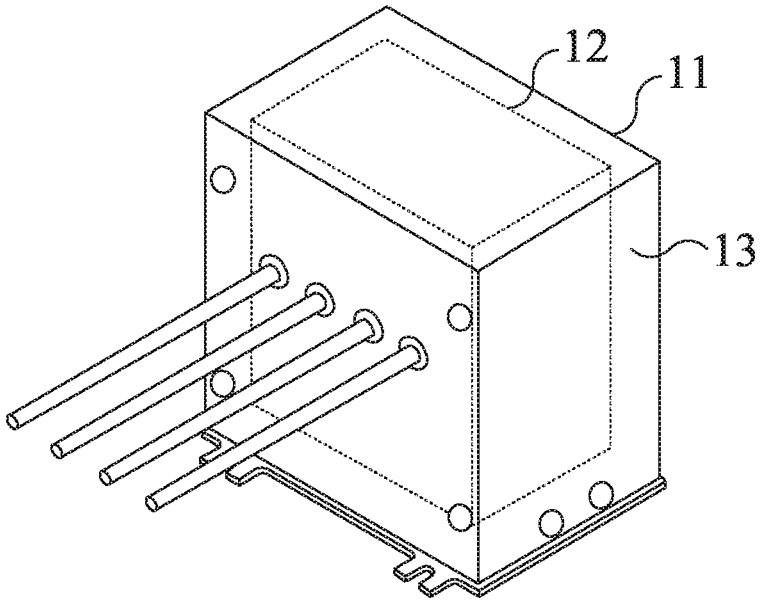
FIG. 1 (Prior Art)
FIG. 1 is a schematic diagram illustrating a protecting structure for a conventional wire-wound magnetic component.

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

For exempting from ingress problems, a wire-wound magnetic component according to the present invention includes a bobbin having a specially designed ingress-protective mechanism. In an embodiment of the present invention as illustrated in FIGS. 2A-2D, and in another embodiment as illustrated in FIGS. 3A-3B, the wire-wound magnetic component includes a magnetic core 21, a coil set 22 and a bobbin 23. The magnetic core 21 has at least one leg 211, e.g. two legs, a top cover magnetic element 212, a bottom cover magnetic element 213 and a plurality of spacer sheets 214. For example, the magnetic core 21 is ring-shaped and constructed from the top cover magnetic element 212, the bottom cover magnetic element 213 and the plurality of spacer sheets 214, wherein the spacer sheets 214 are inserted into leg assemblies at intervals to form the legs 211 with distribution gaps. In another embodiment, the shape of the magnetic core 21 may be varied and selected from, for example, E-I (FIG. 3C), E-E (FIG. 3D), L-L (FIG. 3E), U-I (FIG. 3F), U-U, etc. The bobbin 23 includes a main body 231, two cover plate 232 disposed at opposite sides of the main body 231, and an ingress-protective structure 233. The wire-wound magnetic component further includes an insulating wrapper 234 and a sealing member 235, which function for additional ingress protection. The main body 231 has a hollow portion 2311 for accommodating the legs 211 of the magnetic core 21 or the entire magnetic core 21. A conductive wire 221 is wound around the main body 231 to form the coil 22 set. The coil set 22 may consist of one or more coils, which are properly arranged depending on practical requirements and applications and aligned and interact with the magnetic core 21 for electromagnetic induction. Hereinafter, one coil is exemplified to illustrate the function and operation of the coil set 22. The conductive wire 221 has an unwound free end 2211 extending from the coil 22. Each of the cover plates 232 is disposed at an end of the main body 231 and configured as a flange of the main body 231 so as to define a winding space 230 between the cover plate 232 and the main body 231 for accommodating the coil 22.

Figure 2A:
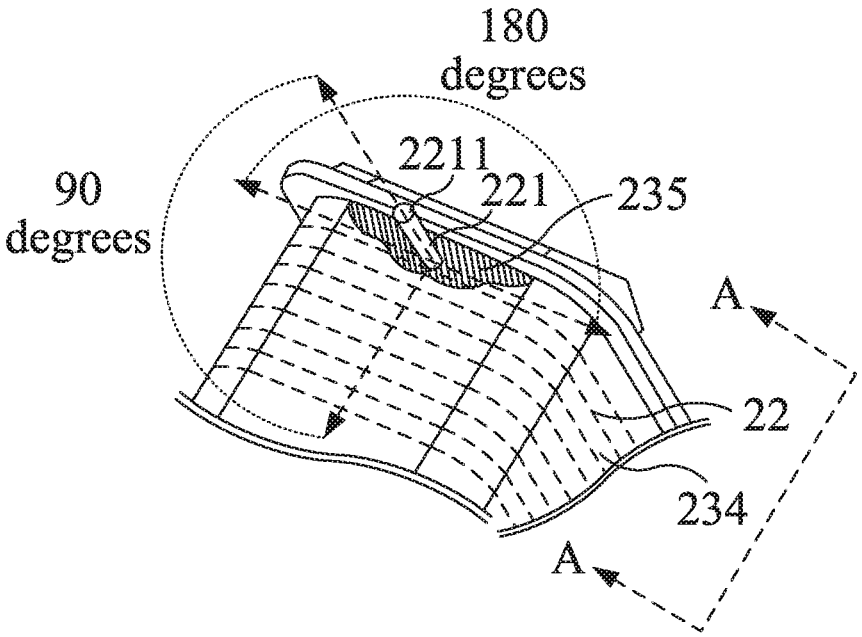
FIG. 2A is a schematic diagram illustrating a wire-wound magnetic component having an improved ingress-protective mechanism according to an embodiment of the present invention.
Figure 2B:
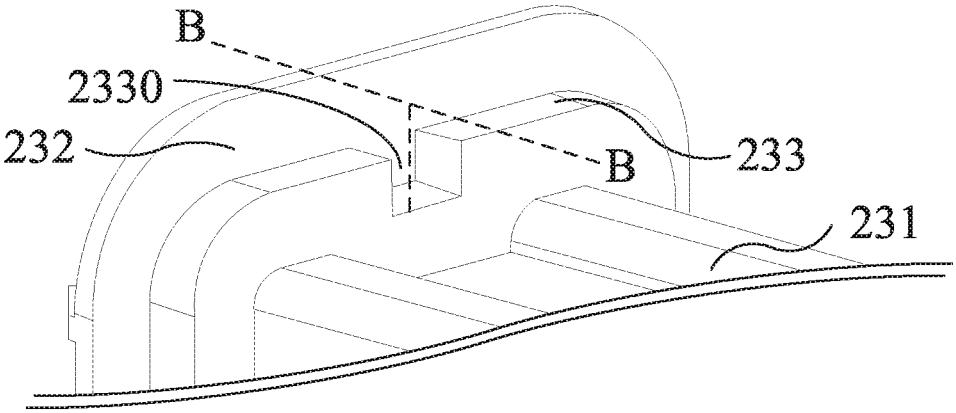
FIG. 2B is a partially enlarged view schematically illustrating the disposition of an ingress-protective structure in the wire-wound magnetic component of FIG. 2A, in which only the main body 231, the cover plate 232 and the ingress-protective structure 233 are shown while the other elements of the wire-wound magnetic component are omitted for focused illustration.
Figure 2C:
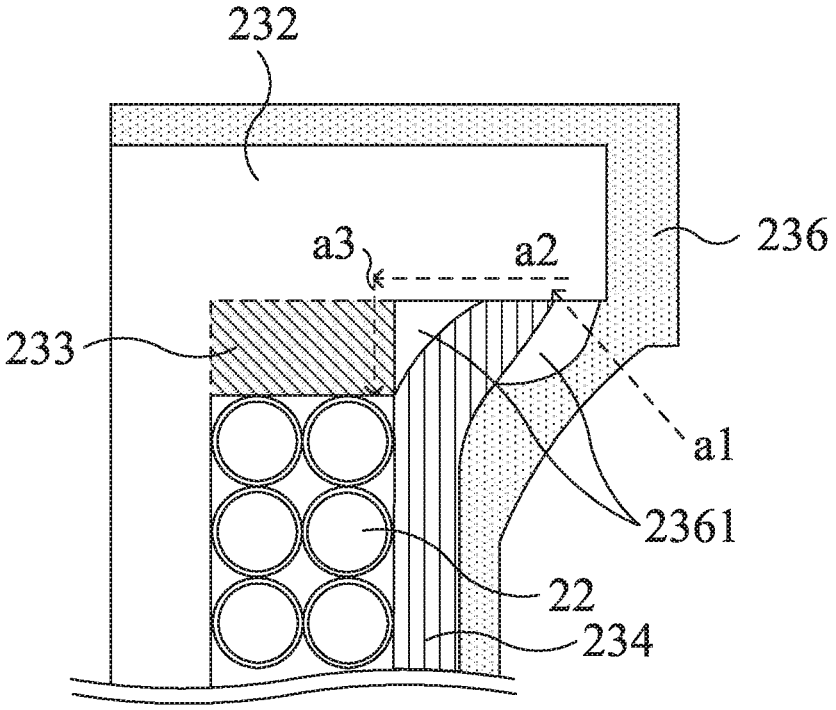
FIG. 2C is a schematic cross-sectional diagram of the wire-wound magnetic component of FIG. 2A, which is taken in a direction substantially along the A-A line.

In the embodiment as illustrated in FIGS. 2A-2D, the conductive wire 221 is wound around the bobbin 23 to form the coil 22 with an unwound free end 2211 left and extending out of the coil 22. In this embodiment, a sealing member 235 is applied to voids around the unwound free end 2211 at an exit from the coil 22 and the inside of the insulating wrapper 234, and an interface between the ingress-protective structure 233 and the insulating wrapper 234. The sealing member 235, in addition to ingress protection, further functions for confining a bending range or angle of the unwound free end 2211. As is understood by those skilled in the art, free moving conductive wire will render relatively large gaps where liquid or other contaminants is likely to enter the device. The sealing member 235 confines the unwound free end 2211 from free movement and thus avoids possible ingress problems resulting from such gaps. Furthermore, an ingress-protective finishing film 236 is applied to the resulting wire-wound magnetic component structure with the sealing member 235, as shown, by rinsing or coating the entire structure with an ingress-protective material such as varnish so as to form a conformal layer, the ingress-protective material such as vanish may alternatively be partially applied to specific sites, e.g. the ingress-protective parts 2361 as shown in FIG. 2C, depending on practical requirements. In other words, the sealing member 235 and the ingress-protective finishing film 236 may be of the same material, e.g. varnish or any other suitable material, or the sealing member 235 and the ingress-protective finishing film 236 may be of different materials and either or both applied to the resulting wire-wound magnetic component structure. In this embodiment, the insulating wrapper 234 is made long enough to reach the cover plate 232 and bend outwards for better insulation. The local application of the sealing member 235 and/or the conformal application of the finishing film 236 further improves ingress-protective effects.

Figure 2D:
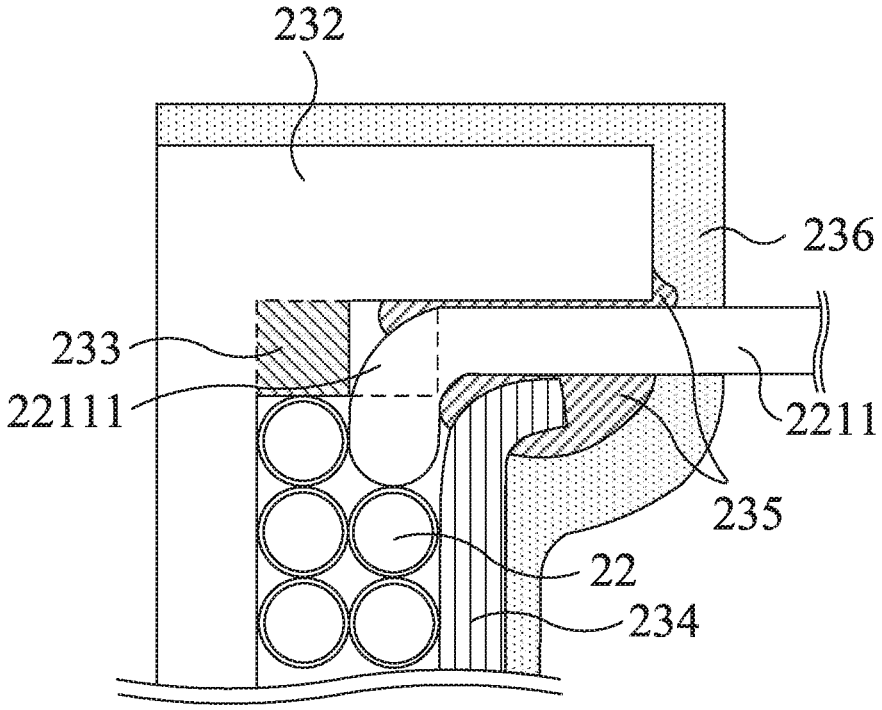
FIG. 2D is another schematic cross-sectional diagram of the wire-wound magnetic component of FIG. 2A, which is taken in a direction substantially along the B-B line.
Figure 3A:
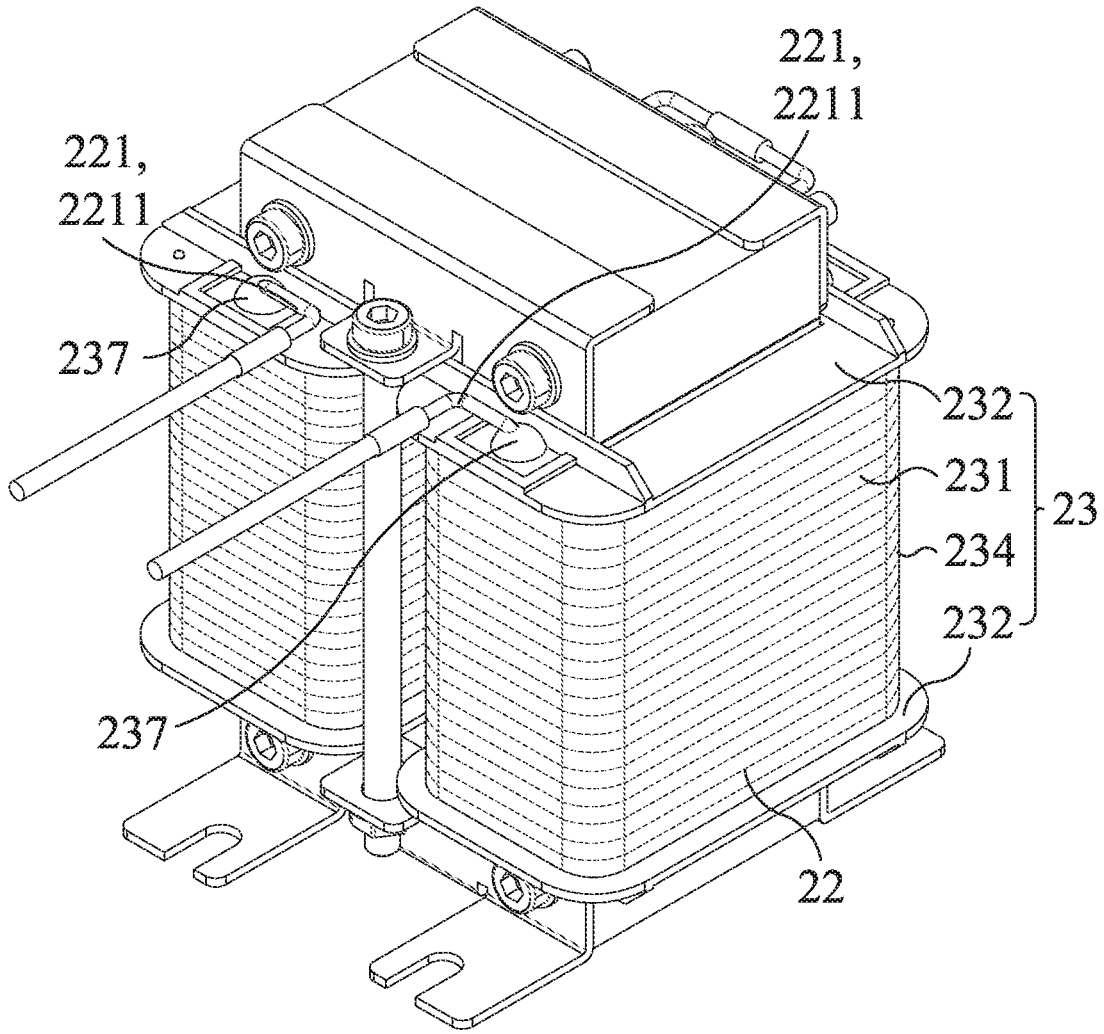
FIG. 3A is a schematic diagram illustrating a wire-wound magnetic component having another improved ingress-protective mechanism according to an embodiment of the present invention.
Figure 3B:
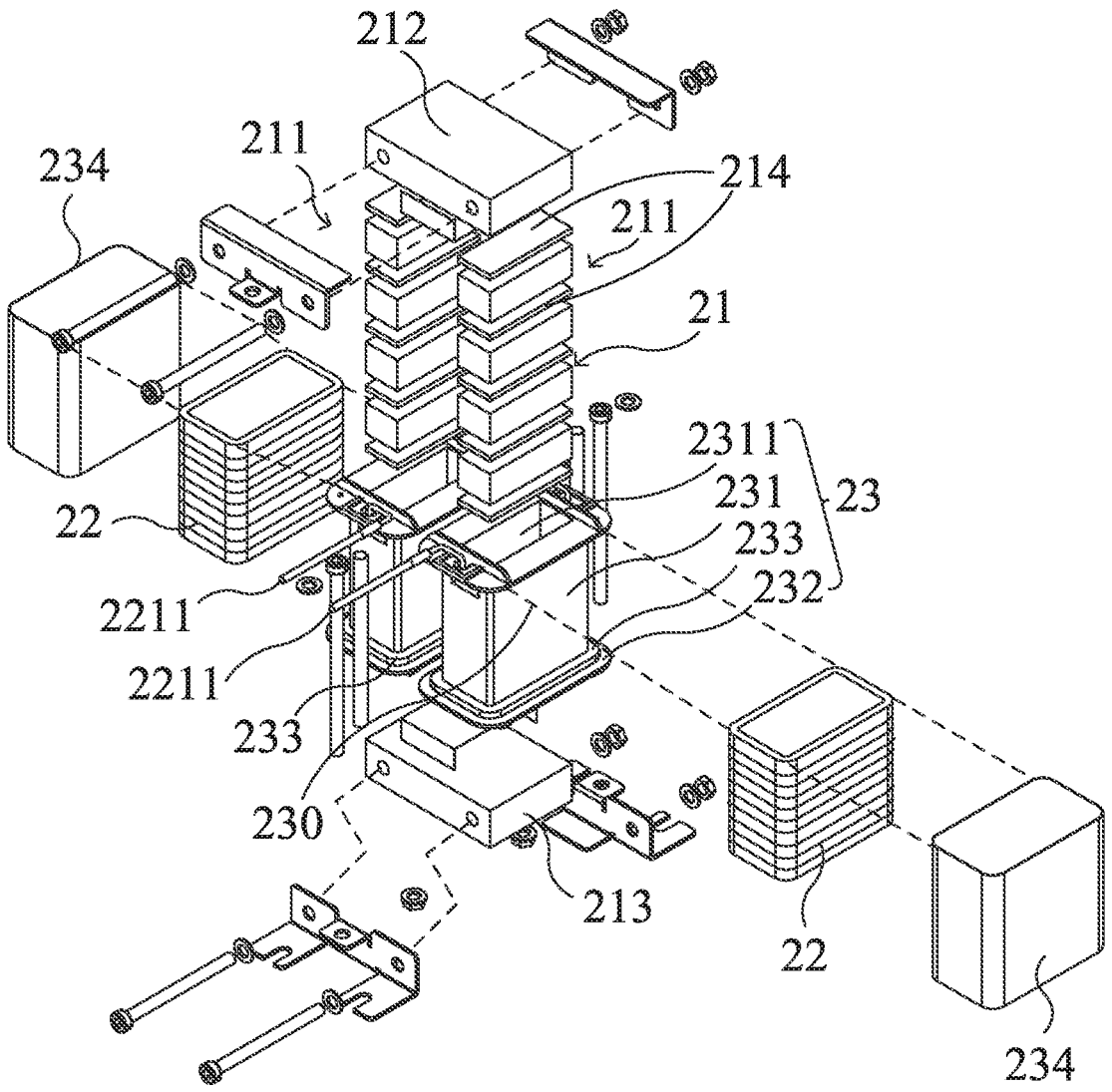
FIG. 3B is an exploded view of the embodiment of wire-wound magnetic component as shown in FIG. 2A.
Figure 3C:
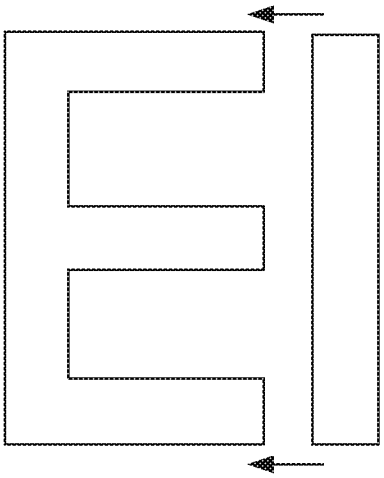
FIGS. 3C-3F are schematic diagrams illustrating core types applicable to the wire-wound magnetic component of the present invention.
Figure 3D:
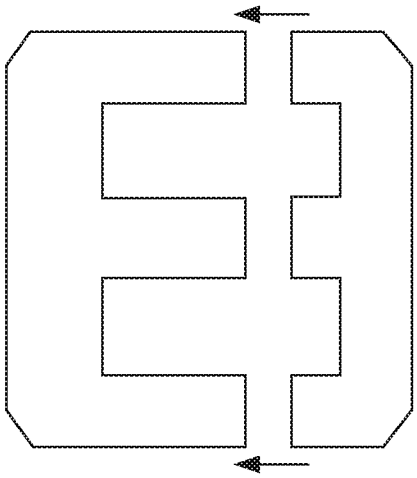
Figure 3E:
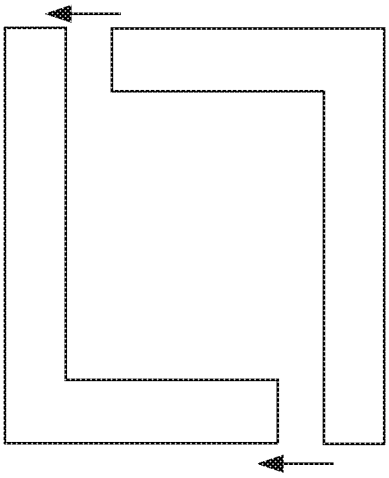
Figure 3F:
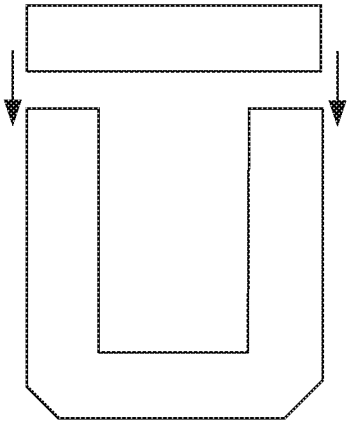

It is to be noted that in the above embodiment, a recess 2330 may be created in the ingress-protective structure 233, as illustrated in FIG. 2B. The recess 2330 provides a space for accommodating a bent portion 22111 (see FIG. 2D) of the unwound free end 2211 so that the end of insulating wrapper 234 can stay close to the ingress-protective structure 233, as well as the cover plate 232 and the ingress-protective structure 233, thereby minimizing the voids around the insulating wrapper 234, where ingress might happen. FIG. 2C is a cross-sectional diagram taken along the A-A line of FIG. 2A, which schematically shows a possible ingress path a1→a2→a3, and it is apparent that the presence of the ingress-protective structure 233, the insulating wrapper 234, the sealing member 235 and the finishing film 236 effectively provide ingress protection. FIG. 2D is a cross-sectional diagram taken along the B-B line of FIG. 2B, which schematically shows the spatial relationship among the unwound free end 2211 of the conductive wire and associated members and how the voids around the unwound free end 2211 are protected from ingress.

Figure 4B:
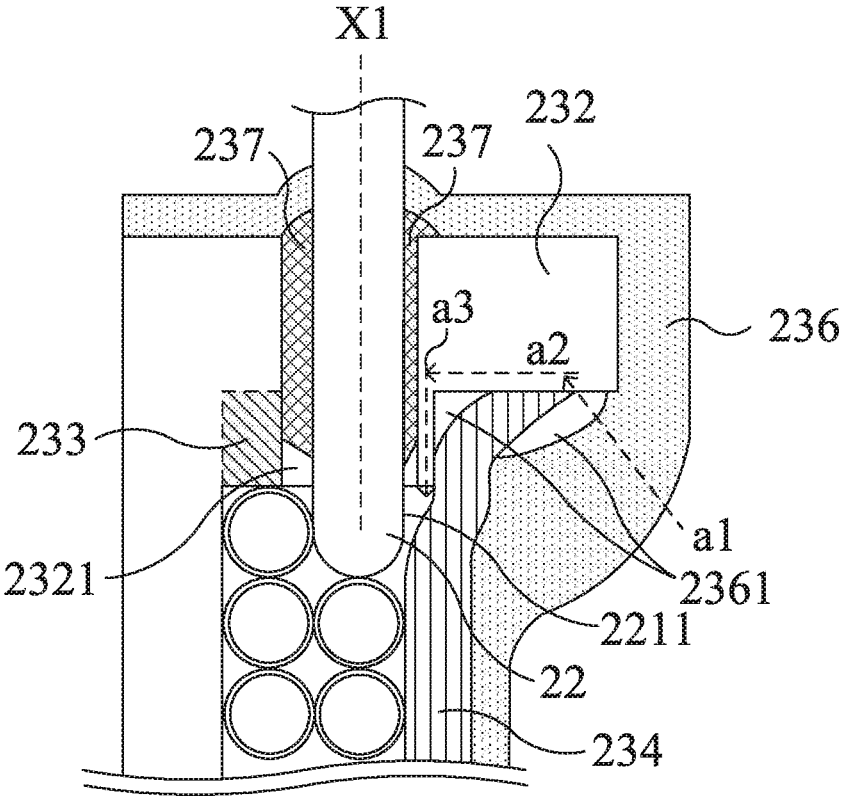
FIG. 4B is a schematic cross-sectional diagram of the wire-wound magnetic component of FIGS. 3A and 4A, which is taken in a direction substantially along the C-C line.
Figure 5A:
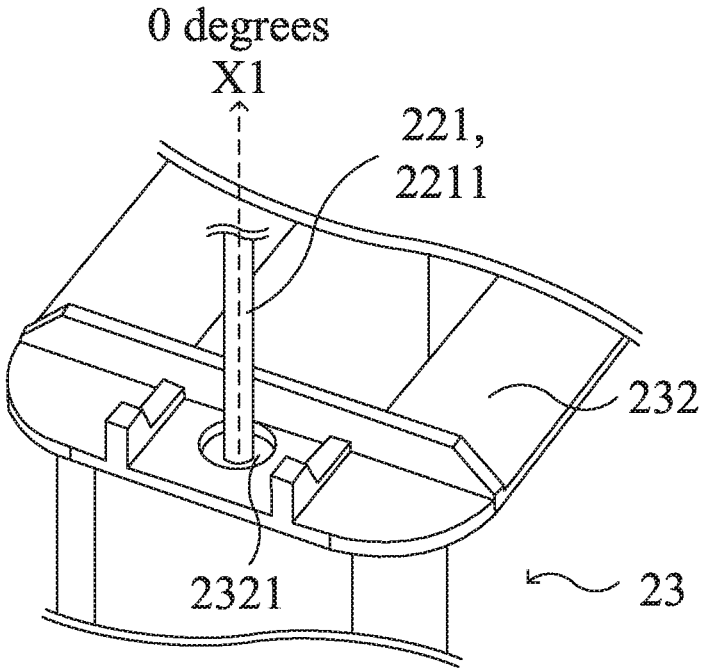
FIG. 5A-FIG. 5D are schematic diagrams illustrating variations of a wire passage of a wire-wound magnetic component according to an embodiment of the present invention.
Figure 5B:
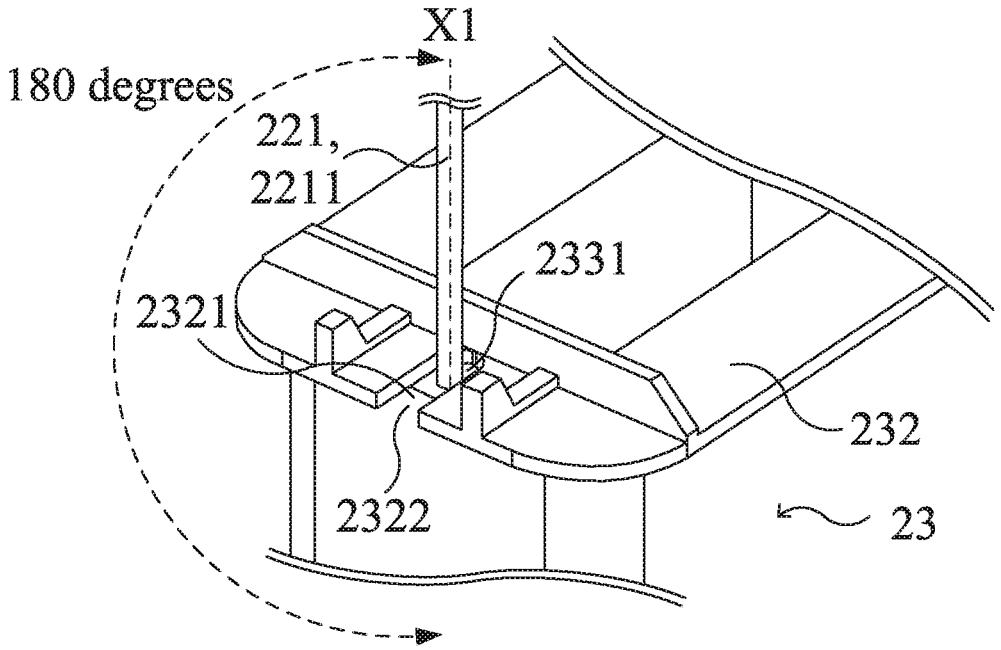
Figure 6:
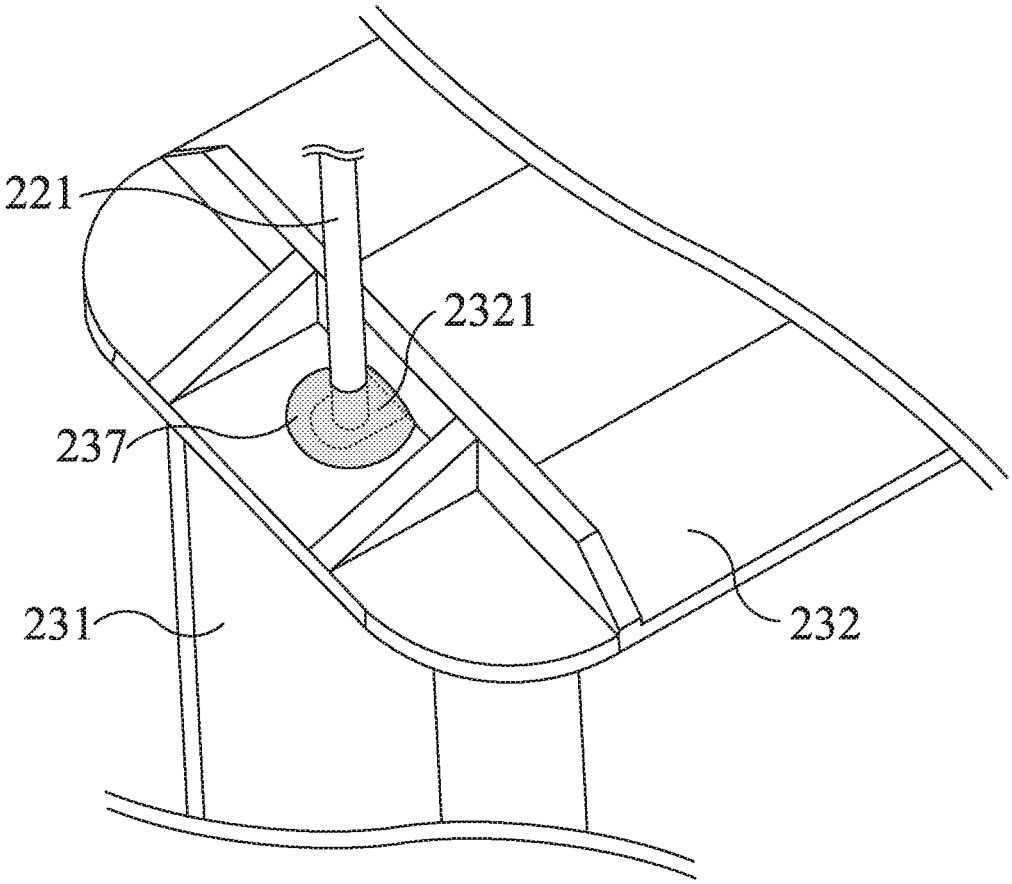
FIG. 6 is a schematic diagram illustrating application of a caulking member to an exit of a wire passage of a wire-wound magnetic component for ingress protection according to an embodiment of the present invention.

In the embodiment as illustrated in FIG. 3A and FIG. 3B, the cover plate 232 and the ingress-protective structure 233 has a wire passage 2321, which is shown in FIGS. 5A and 5B and will be described later, for the unwound free end 2211 of the conductive wire 221 to penetrate through and extend beyond the cover plate 232 and the ingress-protective structure 233 of the bobbin 23. The ingress-protective structure 233 is disposed in the winding space 230 and separates the coil 22 from the corresponding cover plate 232. The insulating wrapper 234 surrounds and wraps both the ingress-protective structure 233 and all of the coil 22. As a result, the insulating wrapper 234 and the cover plate 232 cooperate to seal the winding space 230. In this embodiment, a caulking member 237 is applied to the wire passage 2321 in the cover plate 232 and the ingress-protective structure 233 (see FIG. 4B and FIG. 6) and any other gap for ingress protection so as to confine a bending range or angle of the unwound free end 2211.

The insulating wrapper 234, for example, may be formed of impregnation-type or non-impregnation-type insulation material. The impregnation-type insulation material, for example, may be a fiber polymer, e.g. meta-aramid NOMEX® produced by Dupont (US), glass fiber cloth, or ethyl ester fiber cloth. The insulation material, if impregnated with varnish, may be improved in insulation, mechanical and heat-conductive properties. The non-impregnation-type insulation material, for example, may be a thin-film polymer, e.g. polyimide cloth KAPTON® produced by Dupont (US) or polyester cloth. A hydrophobic thin-film polymer, if impregnated with an ingress-protective material under vacuum and high-pressure conditions, can have improved ingress-protective ability. The ingress-protective material for use in the insulating wrapper 234, for example, may be varnish. It is known that varnish has properties of good isolation, high binding capability, good noise reduction, good weather resistance, good heat dissipation, and low cost. Therefore, it is suitable to be applied to a surface of an article to for a protective film. Varnish can be cured in a variety of ways, either at a normal temperature or a high temperature.

The sealing member 235 and the caulking member 237, for example, may be formed of an organic material such as a hot-melt adhesive, varnish, or an epoxy resin adhesive; an inorganic material such as a metal screen; or a composite material such as an epoxy resin adhesive mixed with inorganic fillers.

Figure 4A:
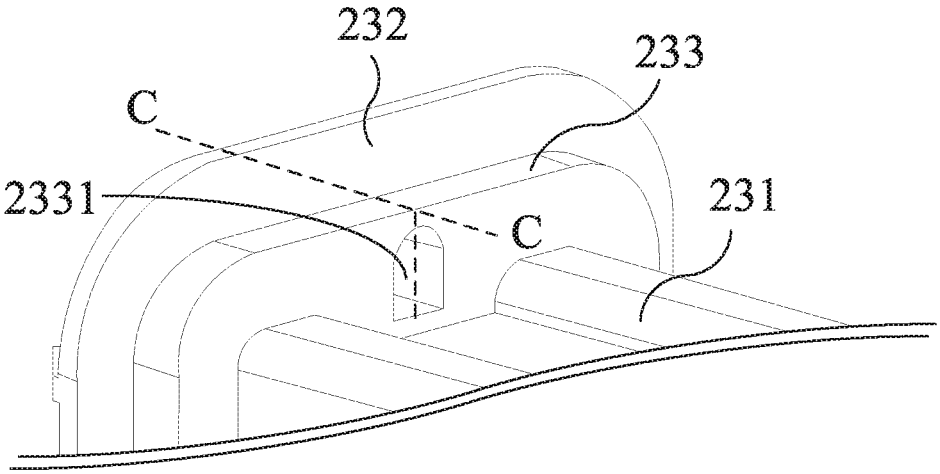
FIG. 4A is a partially enlarged view schematically illustrating the disposition of another ingress-protective structure in the wire-wound magnetic component of FIG. 3A, in which only the main body 231, the cover plate 232 and the ingress-protective structure 233 are shown while the other elements of the wire-wound magnetic component are omitted for focused illustration.

In this embodiment, the ingress-protective structure 233 is a flat plate as illustrated in FIGS. 4A and 4B, wherein FIG. 4A schematically illustrates a perspective view of the ingress-protective structure 233, and FIG. 4B schematically illustrates a cross-sectional view of the ingress-protective structure 233. The ingress-protective structure 233 is secured onto or integrally formed with the cover plate 232 at a side and coupled to the main body 231 at an opposite side. As shown, the disposition of the ingress-protective structure 233 between the cover plate 232 and the main body 231 elongates the leak path for water ingress through the cover plate 232, the ingress-protective structure 233 and the insulating wrapper 234 to coil 22, as indicated by the dash arrows a1, a2 and a3, to reach the coil 22 from the external with the distance a3, thereby resulting in a better ingress-protecting effect. Since the insulating wrapper 234 wraps not only the coil 22 but also the ingress-protective structure 233, the coil can be better protected. The material of the ingress-protective structure 233 may be the same as or different from the cover plate 232 and/or the main body 231. When there is a heterogeneous junction, it is preferred that the sealing member 235 is applied to the junctions and seams of the bobbin 23, where different materials are joined together, for ingress protection. Furthermore, the ingress-protective structure 233 has a wire passage 2331 aligned with the wire passage 2321 of the cover plate 232 so that the unwound free end of the conductive wire 221 extending from the coil 22 and the inside of the insulating wrapper 234 can penetrate through the wire passages 2321 and 2331 to extend beyond the bobbin 23 without bending inside the bobbin 23. Preferably, the unwound free end 2211 of the conductive wire 221 protrudes from the coil in a direction parallel to an axis of the coil.

Figure 5C:
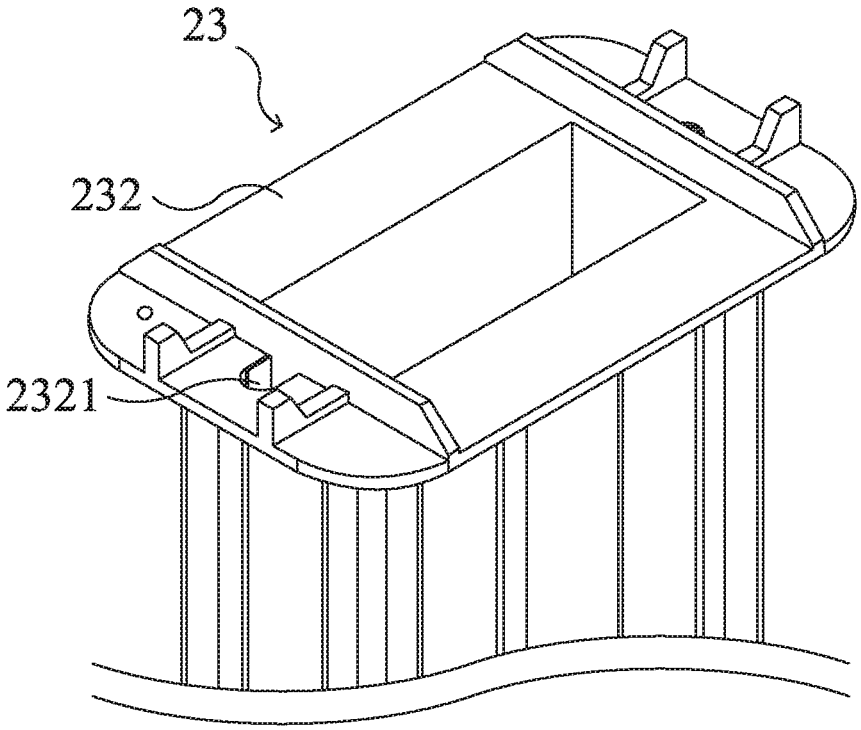
Figure 5D:
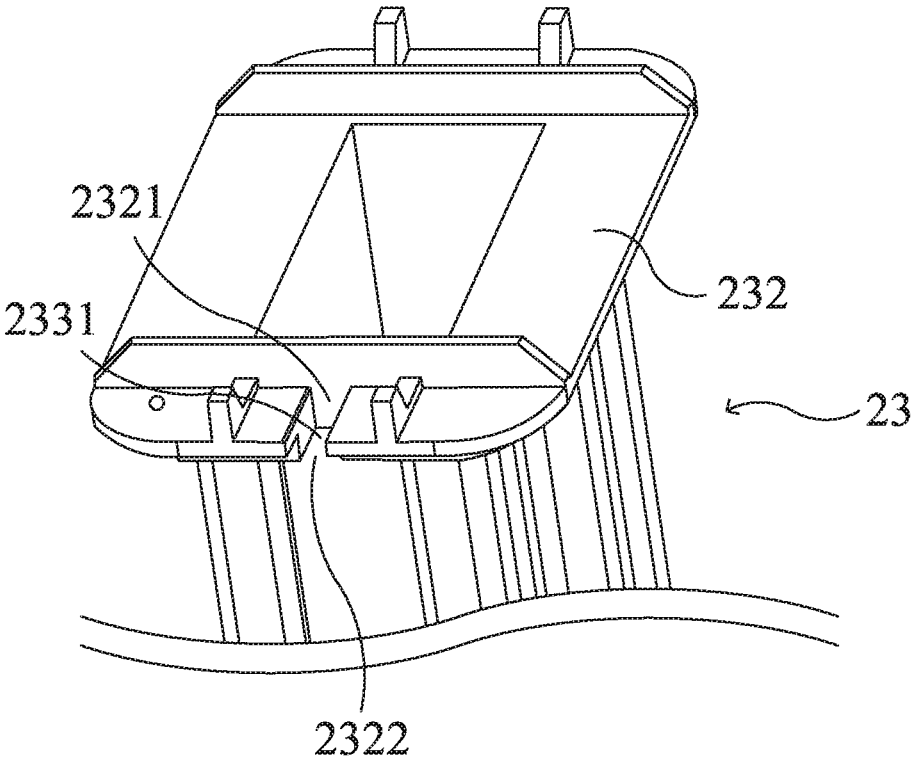

The wire passages 2321 and 2331 as mentioned above may be through holes created in the cover plate 232 and the ingress-protective structure 233, respectively, with respective axes in parallel to the axis X1 of the coil 22, as illustrated in FIG. 5A, so that the unwound free end 2211 extends and penetrates the through hole to exit from the bobbin in a limited-bending manner, i.e. in a confined bending range or angle of the unwound free end 2211. Alternatively, the wire passage 2321 of the cover plate 232 can be an open-ended through hole with an axis in parallel to the axis X1 of the coil 22, as illustrated in FIG. 5B, while the wire passage 2331 of the ingress-protective structure 233 is still a closed through hole, so that the unwound free end 2211 extends from and may engage into the through hole from the open end 2322. In a further embodiment, the wire passage 2331 of the ingress-protective structure 233 may also be made with an open end, as well as the wire passage 2321 of the cover plate 232, as illustrated in FIG. 5D.

In this way, the unwound free end 2211 can exit from the bobbin in a limited-bending manner, i.e. in a confined bending range or angle of the unwound free end 2211. In addition to the above exemplified configurations, the wire passages 2321 and/or 2331 may be modified to have any other suitable configuration or shape according to practical requirements. For example, it may be circular, inward or outward U-shaped, slot, or any other passage means that properly confines the movement of the coil wire. FIG. 5C and FIG. 5D schematic illustrate two other examples. The configurations of the wire passages 2321 and 2331 may be the same or different as long as the combined configuration allows the unwound free end 2211 to penetrate therethrough or engage therewith. It is preferable that the size of the entrance to the wire passages 2321 and 2331 is as small as possible to minimize the possibility of ingression as long as the unwound free end 2211 can smoothly pass the wire passages 2321 and 2331.

Figure 7:
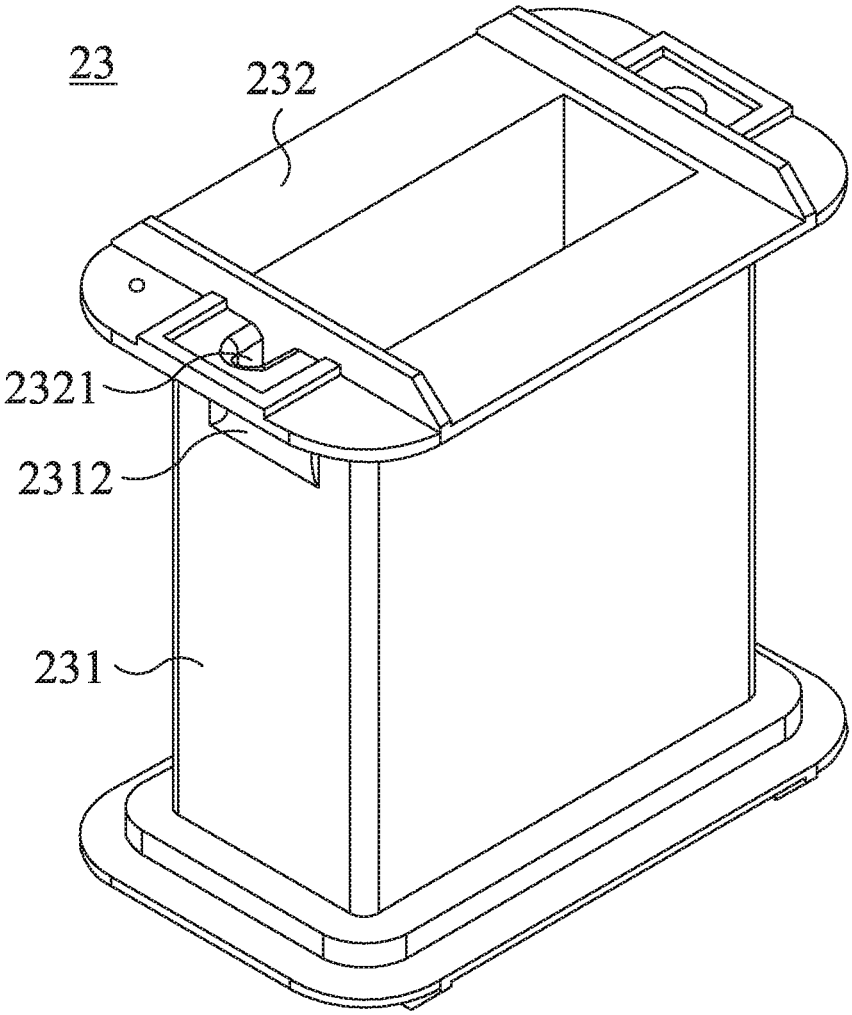
FIG. 7 is a schematic diagram illustrating an inward slant structure for guiding a coil wire to enter a wire passage of a wire-wound magnetic component according to an embodiment of the present invention.

Preferably but not necessary, the main body 231 of the bobbin 23 has an inward slant structure 2312 retracted from a surface of the main body 231 and disposed between the coil 22 and the wire passage 2321 of the cover plate 232 and 2323 the ingress-protective structure 233, as illustrated in FIG. 7. The unwound free end 2211 extending from the coil 22 is guided by the inward slant structure 2312 to reach the wire passages 2321 and 2331. It is understood that compared with prior art, the wire passage confines the free movement of the unwound free end 2211.

The resulting wire-wound magnetic component structure as described above is, preferably but not necessarily, further rinsed with an ingress-protective material to form an ingress-protective finishing film 236 (FIG. 4B) that is conformally coated on a surface of the cover plate 232, the ingress-protective structure 233 and the insulating wrapper 234 for providing surface protection of the wire-wound magnetic component. The ingress-protective material of the ingress-protective finishing film, for example, may be varnish, hot-melt glue, epoxy resin or any other suitable material with satisfactory water resistance and good adhesion to the wire-wound magnetic component structure.

Figure 8A:
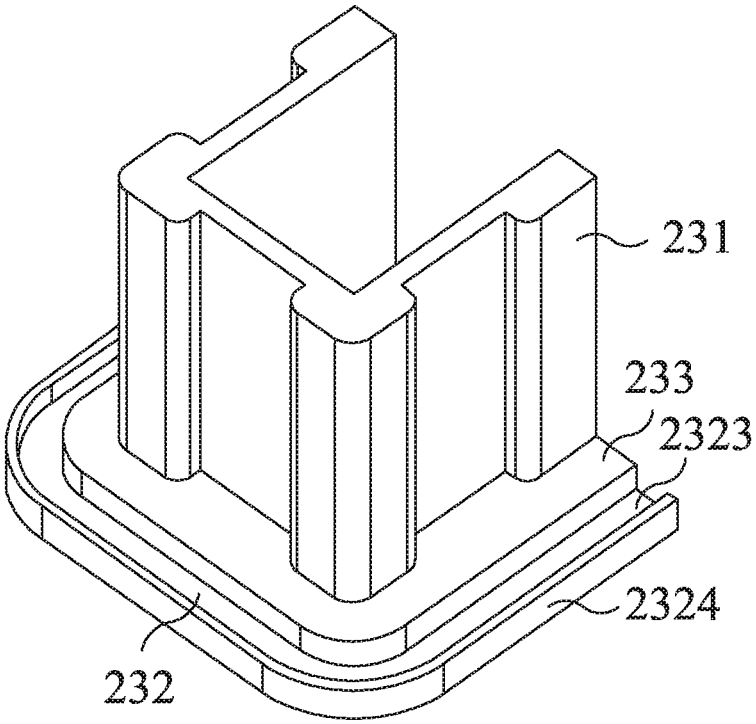
FIG. 8A is a schematic diagram illustrating a wire-wound magnetic component having a further improved ingress-protective mechanism according to an embodiment of the present invention.
Figure 8B:
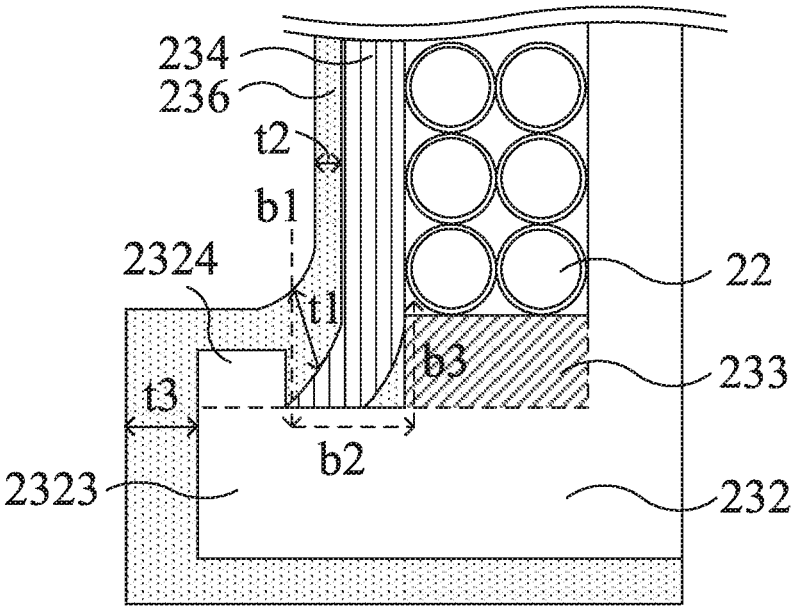
FIG. 8B is a cross-sectional diagram schematically illustrating a configuration of the insulating wrapper in the wire-wound magnetic component of FIG. 8A.
Figure 8C:
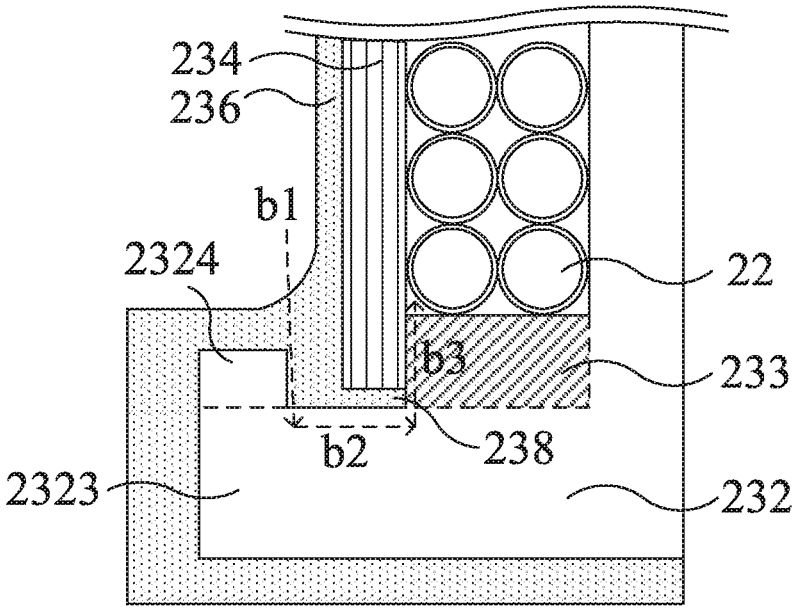
FIG. 8C is a cross-sectional diagram schematically illustrating another configuration of the insulating wrapper in the wire-wound magnetic component of FIG. 8A.

Preferably but not necessary, the cover plate 232 may include a base 2323; and a fence structure 2324 protruding from the base 2323 toward the main body 231 and surrounding the insulating wrapper 234, as schematically illustrated in FIG. 8A and FIG. 8B, wherein FIG. 8A schematically illustrates a perspective view of the fence structure 2324, and FIG. 8B schematically illustrates a cross-sectional view of the fence structure 2324. Due to the presence of the fence structure 2324, the ingress-protective material, e.g. varnish, which is conformally coated on a surface of the cover plate 232, the ingress-protective structure 233 and the insulating wrapper 234 to form the ingress-protective finishing film 236, can be retained on the cover plate 232. With the fence structure 2324, the leak path to reach the coil 22 within the insulating wrapper 234 from the external, as indicated by the dash arrows b1, b2 and b3, can be elongated due to the accumulation of the ingress-protective material between the fence structure 2324 and the insulating wrapper 234. The ingress-protecting effect can thus be improved. It is preferred that the thickness t1 of a portion of the finishing film 236 near the outward-bending insulating wrapper 234 is greater than other portions of the finishing film 236, e.g. the thickness t2 and the thickness t3 shown in FIG. 8B for better ingress-protecting effects. In an alternative embodiment as illustrated in FIG. 8C, the insulating wrapper 234 is not long enough to reach the cover plate 232, and has a gap 238 between an end of the insulating wrapper 234 and the cover plate 232. Nevertheless, the local or conformal application of the sealing member 235 and/or finishing film 236 will fill the gaps without ingress problems. The sealing member 235 and/or finishing film 236 may even overflow from the space defined between the fence structure 2324 and the ingress-protective structure 233 for better ingress protection.

Figure 9A:
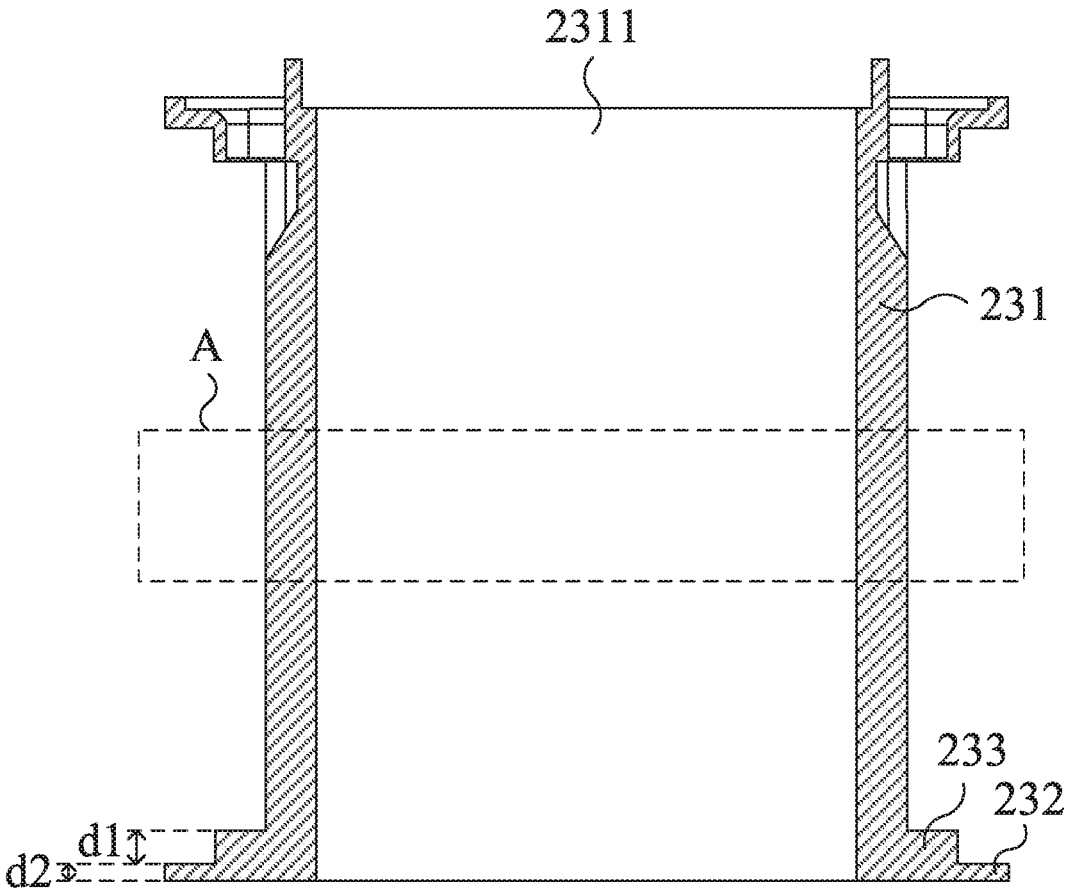
FIG. 9A is a cross-sectional diagram schematically illustrating a dismantlable bobbin of a wire-wound magnetic component according to an embodiment of the present invention.
Figure 9B:
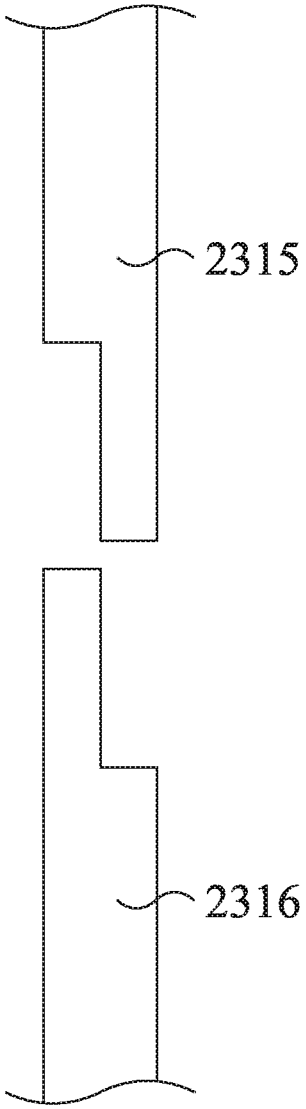
FIG. 9B and FIG. 9C are cross-sectional diagram schematically exemplifying dismantled pieces of a bobbin of a wire-wound magnetic component according to an embodiment of the present invention.
Figure 9C:
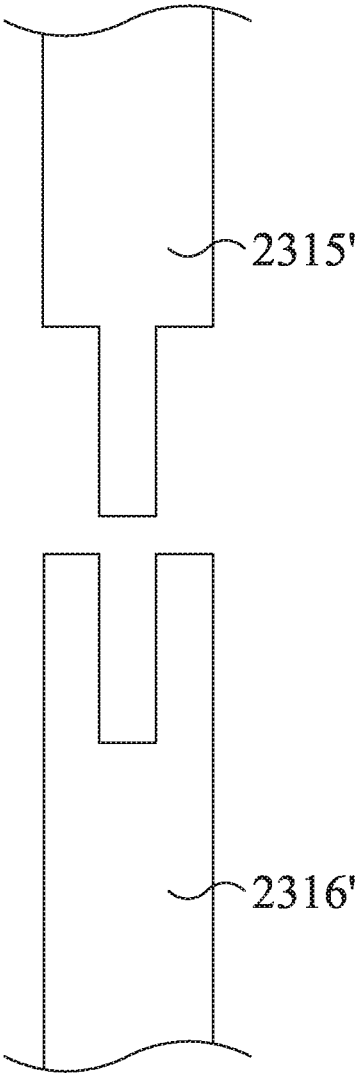
Figure 10:
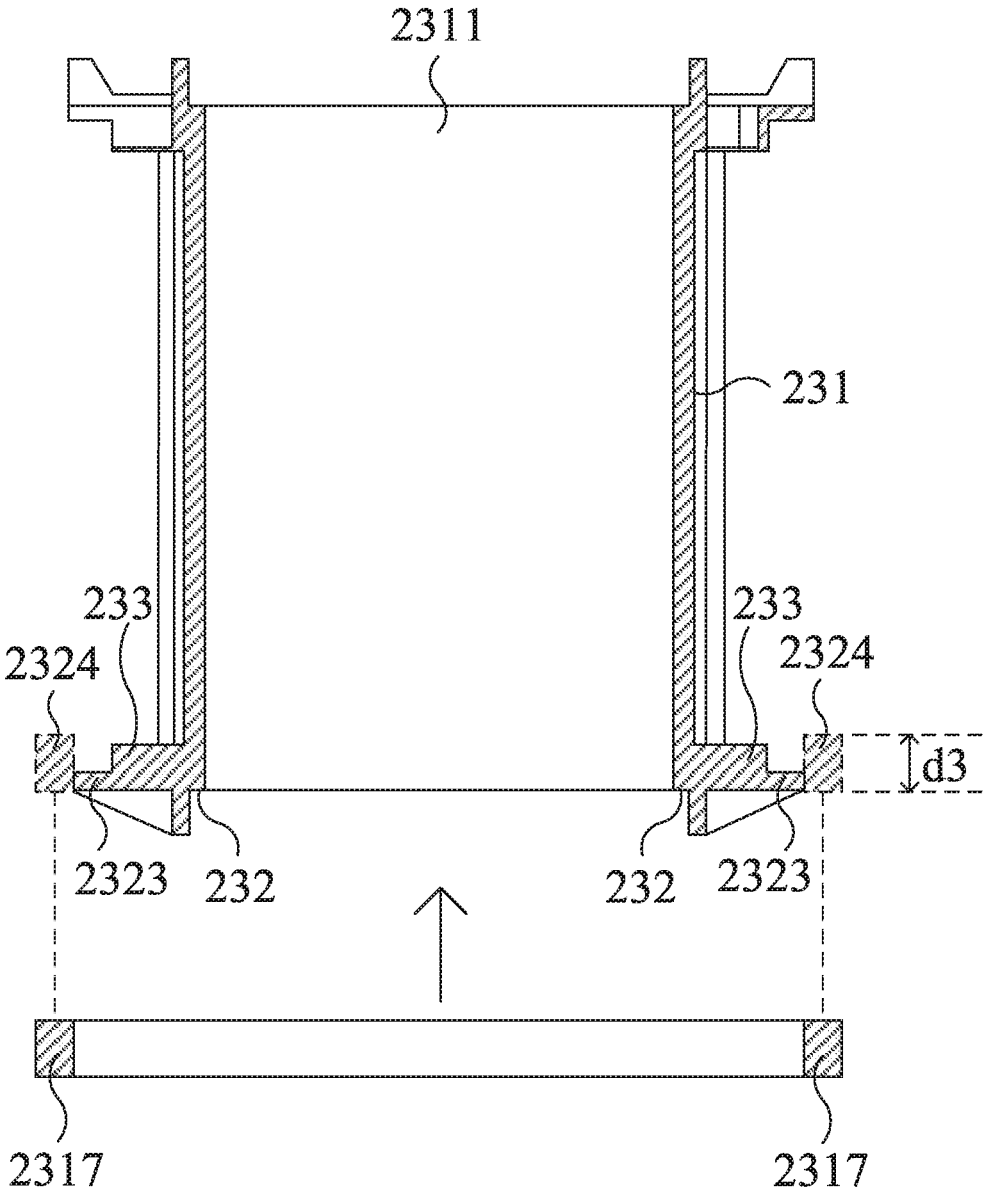
FIG. 10 is a cross-sectional diagram schematically exemplifying dismantled pieces of a bobbin of a wire-wound magnetic component according to another embodiment of the present invention.

The main body 231, cover plate 232, ingress-protective structure 233 of the bobbin 23 according to the present invention can be integrally formed or assembled in a variety of ways. For example, the main body 231 can be constructed with at least two zigzag pieces engaging with each other, as illustrated in FIG. 9A, FIG. 9B and FIG. 9C, wherein FIG. 9B and FIG. 9C are enlarged views of the portion A shown in FIG. 9A, each schematically showing an example of the zigzag pieces 2315/2316 and 2315'/2316'. Furthermore, other portions of the bobbin 23 may be assembled with engageable parts. For example, as schematically illustrated in FIG. 10, the fence structure 2324 may be implemented with a separate ring 2317. The height d3 of the fence structure 2324 depends on how much the ingress-protective material is to be accumulated, and it is preferred that the thickness d3 is greater than the thickness d2 of the base 2323 of the cover plate 232, and assembled to the circumference of the cover plate 232 to form the fence structure 2324. Preferably but not necessarily, the thickness d3 of the fence structure is greater than the thickness d1 of the ingress-protective structure 233 plus the thickness d2 of the base 2323 of the cover plate 232, and more preferably, the thickness d1 is greater than the thickness d2.

With the use of one or more of the above-described designs in a wire-wound magnetic component, the wire-wound magnetic component can be protected from ingress While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wire-wound magnetic component, comprising:

a magnetic core having at least one leg;

a coil set aligned and interacting with the magnetic core for electromagnetic induction, wherein the coil set includes one or more coils;

a bobbin including:

a main body having a hollow portion for accommodating the at least one leg of the magnetic core, and winding therearound a conductive wire to form the coil set, wherein the conductive wire has an unwound free end extending from the coil set;

a cover plate disposed at an end of the main body and configured as a flange of the main body so as to define a winding space of the main body for accommodating the coil set, and having a wire passage for the unwound free end of the conductive wire to penetrate through and extend beyond the bobbin in a limited bending manner; and an ingress-protective structure disposed in the winding space and separating the entire coil set from the cover plate;

an insulating wrapper surrounding the ingress-protective structure and the coil set, and together with the cover plate, sealing the entire coil set and the ingress-protective structure; and a sealing member applied to at least a space between an end of the insulating wrapper and the cover plate; and a caulking member applied to voids inside the wire passage and an interface between the ingress-protective structure and the insulating wrapper.

2. The wire-wound magnetic component according to claim 1, further comprising an ingress-protective finishing film conformally coated on surfaces of the bobbin and the insulating wrapper to provide surface protection of the wire-wound magnetic component.

3. The wire-wound magnetic component according to claim 2, wherein the sealing member and the ingress-protective finishing film are of different materials.

4. The wire-wound magnetic component according to claim 1, wherein the sealing member is implemented with an ingress-protective finishing film conformally coated on surfaces of the bobbin and the insulating wrapper to provide surface protection of the wire-wound magnetic component.

5. The wire-wound magnetic component according to claim 1, further comprising a caulking member made of an ingress-protective material and applied to voids around the unwound free end at an exit from the coil set for ingress protection while confining a bending range of the unwound free end.

6. The wire-wound magnetic component according to claim 1, wherein the sealing member is further applied to an interface between the ingress-protective structure and the insulating wrapper.

7. The wire-wound magnetic component according to claim 1, wherein the unwound free end of the conductive wire protrudes from the coil set in a direction parallel to an axis of the coil set.

8. The wire-wound magnetic component according to claim 1, wherein the wire passage is a through hole created in the cover plate and the ingress-protective structure with an axis in parallel to the axis of the coil set so that the unwound free end of the conductive wire extends and penetrates the through hole to exit from the bobbin in a limited bending manner.

9. The wire-wound magnetic component according to claim 1, wherein the wire passage is an open-ended through hole created in the cover plate and the ingress-protective structure with an axis in parallel to the axis of the coil set so that the unwound free end of the conductive wire extends and engages into the through hole from the open end to exit from the bobbin in a limited bending manner.

10. The wire-wound magnetic component according to claim 1, wherein the ingress-protective structure has a wire passage in communication with a wire passage of the cover plate and the ingress-protective structure for the unwound free end of the conductive wire to penetrate through and extend beyond the bobbin in a limited bending manner.

11. The wire-wound magnetic component according to claim 1, wherein the cover plate includes:

a base; and a fence structure protruding from the base toward the main body and surrounding the insulating wrapper.

12. The wire-wound magnetic component according to claim 11, wherein a height of the fence structure is greater than a thickness of the base.

13. The wire-wound magnetic component according to claim 12, wherein a thickness of the ingress-protective structure is greater than a thickness of the base of the cover plate.

14. The wire-wound magnetic component according to claim 1 wherein the sealing member is formed of varnish, hot-melt glue, epoxy resin or a combination thereof.

15. The wire-wound magnetic component according to claim 1, wherein the main body of the bobbin is constructed with at least two zigzag pieces engaging with each other.

16. The wire-wound magnetic component according to claim 1, wherein the main body of the bobbin has an inward structure retracted from a winding surface of the main body and disposed between the coil set and the wire passage of the cover plate, and the unwound free end of the conductive wire extending from the coil set is guided by the inward structure to reach the wire passage.

17. The wire-wound magnetic component according to claim 1, wherein an end of the insulating wrapper extends to reach the cover plate and further extends away from the main body with the coil substantially along the cover plate, and the sealing member is applied to voids around the bent portion of the insulating wrapper.

18. The wire-wound magnetic component according to claim 1, wherein an end of the insulating wrapper has a gap from the cover plate, and the sealing member is applied to the gap.

19. A wire-wound magnetic component, comprising:

a magnetic core having at least one leg;

a coil set aligned and interacting with the magnetic core for electromagnetic induction, wherein the coil set includes one or more coils;

a bobbin including:

a main body having a hollow portion for accommodating the at least one leg of the magnetic core, and winding therearound a conductive wire to form the coil set, wherein the conductive wire has an unwound free end extending from the coil set;

a cover plate disposed at an end of the main body and configured as a flange of the main body so as to define a winding space of the main body for accommodating the coil set; and an ingress-protective structure disposed in the winding space and separating the coil set from the cover plate;

an insulating wrapper surrounding the ingress-protective structure and the coil set, and together with the cover plate, sealing the entire coil set and the ingress-protective structure; and an ingress-protective finishing film applied to at least a space between an end of the insulating wrapper and the cover plate and conformally coated on surfaces of the bobbin and the insulating wrapper to provide surface protection.

* * * * *